US006045690A

United States Patent [19]

Fujiyama et al.

[11] Patent Number: 6,045,690

[45] Date of Patent: Apr. 4, 2000

[54] PROCESS FOR FLUID CATALYTIC CRACKING OF HEAVY FRACTION OILS

[75] Inventors: Yuichiro Fujiyama; Michiaki Adachi; Toshiyasu Okuhara; Shunichi Yamamoto, all of Yokohama, Japan

[73] Assignee: Nippon Oil Co., Ltd., Tokyo, Japan

[21] Appl. No.: 08/968,499

[22] Filed: Nov. 12, 1997

[30] Foreign Application Priority Data

Nov. 15, 1996 [JP] Japan ..... 8-318617
Nov. 15, 1996 [JP] Japan ..... 8-318618

[51] Int. Cl.[7] ..... C10G 35/00

[52] U.S. Cl. ..... 208/153; 208/127; 208/164; 208/120

[58] Field of Search ..... 208/127, 164, 208/153

[56] References Cited

U.S. PATENT DOCUMENTS

| | | | |
|---|---|---|---|
| 3,074,878 | 1/1963 | Pappas | 208/127 |
| 3,835,029 | 9/1974 | Larson et al. | 208/113 |
| 4,411,773 | 10/1983 | Gross | 208/164 |
| 4,514,285 | 4/1985 | Niccum et al. | 208/148 |
| 5,462,652 | 10/1995 | Wegener | 208/167 |
| 5,538,625 | 7/1996 | Sigaud et al. | 208/127 |
| 5,589,139 | 12/1996 | Zinke et al. | 422/144 |

FOREIGN PATENT DOCUMENTS

| | | |
|---|---|---|
| 0 254 333 A1 | 1/1988 | European Pat. Off. . |
| 0 305 720 A2 | 3/1989 | European Pat. Off. . |
| 0 398 557 A1 | 11/1990 | European Pat. Off. . |

*Primary Examiner*—Helane Myers
*Attorney, Agent, or Firm*—Kubovcik & Kubovcik

[57] ABSTRACT

An object is to increase cracking rate of heavy fraction oils while producing a lessened amount of dry gases generated by the hydrogen transfer reaction and by the overcracking to obtain light fraction olefins in a high yield. A process for the fluid catalytic cracking of heavy fraction oils, which comprises steps of feeding the heavy fraction oils to a raw oil introducing portion provided at a reaction zone inlet; feeding a part of a regenerated catalyst taken out of a catalyst-regenerating zone to a catalyst introducing portion provided at a reaction zone inlet; and feeding another part of the regenerated catalyst taken out of the catalyst-regenerating zone to at least one catalyst introducing portion which is provided between the catalyst introducing portion provided at the reaction zone inlet and reaction zone outlet, the catalytic cracking in the reaction zone being carried out under conditions of a contact time of 0.1 to 3.0 sec. a reaction zone outlet temperature of 530 to 700° C. and a catalyst/oil ratio of 10 to 50 wt/wt, thereby producing light fraction olefins.

9 Claims, No Drawings

PROCESS FOR FLUID CATALYTIC CRACKING OF HEAVY FRACTION OILS

BACKGROUND OF THE INVENTION

1. Technical Field

This invention relates to a process for catalytic cracking of a heavy fraction oil, particularly to a fluid catalytic cracking (FCC) process which comprises cracking a heavy fraction oil to obtain olefins which are light fraction oils such as ethylene, propylene, butene and pentene.

2. Description of the Prior Art

In a usual catalytic cracking technique, petroleum-derived hydrocarbons are catalytically cracked with a catalyst thereby to obtain gasoline as the main product, a small amount of LPG, a cracked gas oil and the like, and coke deposited on the catalyst is then burnt away with air to recycle the regenerated catalyst for reuse.

In recent years, however, there has been a tendency that a fluid catalytic cracking apparatus is utilized not as an apparatus for producing gasoline but as an apparatus for producing light fraction olefins for use as petrochemical materials. Such utilization of an original fluid catalytic cracking apparatus as an olefin producing apparatus is economically advantageous particularly to an oil refinery in which a petroleum refining factory and a petrochemical factory are highly closely combined.

On the other hand, much attention has been paid to environmental problems, and therefore regulation of the contents of olefins and aromatics in gasoline for automobiles, obligation to add oxygen-containing materials (MTBE or the like), or the like has started to be enforced. In consequence, it (an be anticipated that alkylates and MTBE will be increasingly demanded as base materials for high-octane gasoline in place of FCC gasoline and catalytically reformed gasoline. Therefore, it will be necessary to increase the production of propylene and butene which are raw materials for these base materials.

Methods for producing the light fraction olefins by the fluid catalytic cracking of a heavy fraction oil include methods which comprise contacting a raw oil with a catalyst for a shortened time (U.S. Pat. Nos. 4,419,221, 3,074,878 and 5,462,652, and European Patent No. 315,179A), a method which comprises carrying out a cracking reaction at a high temperature (U.S. Pat. No. 4,980,053), and methods which comprise using pentasil type zeolites (U.S. Pat. No. 5,326,465 and Japanese Patent National Publication (Kohyo) No. Hei 7-506389 (506389/95)).

However, these methods have common problems. That is to say, since a raw oil is heated in a reaction zone inlet to gasify it, a catalyst having a higher temperature than a preferable reaction temperature is required to be introduced, so that the raw oil is partially brought into contact with the high-temperature catalyst to bring about cracking; since a cracking reaction is an endothermic reaction, the temperature lowers after the start of the reaction; and since the reaction at the high temperature is severe, a coke is deposited on the catalyst, so that the catalyst rapidly deteriorates. Furthermore, the above methods have another problem that the yield of light fraction olefins lowers owing to overcracking and a hydrogen transfer reaction of the oil which comes out of a reaction zone.

SUMMARY OF THE INVENTION

An object of this invention is to provide a process for the fluid catalytic cracking of heavy fraction oils, which is capable of increasing the cracking rate of heavy fraction oils while producing a lessened amount of dry gases such as hydrogen gas, methane gas and ethane gas generated by the hydrogen transfer reaction which occurs after the cracking reaction and by the overcracking of light fractions to obtain light fraction olefins such as ethylene, propylene, butene and pentene in a high yield.

The present inventors have intensively researched mainly with the intention of obtaining light fraction olefins in a high yield by increasing a cracking ratio of a heavy fraction component and by controlling the occurrence of cracking and the generation of a dry gas due to the overcracking of light fraction oil in a process for the fluid catalytic cracking of a heavy fraction oil at a high temperature. As a result, it has been found that the above object can be achieved by employing a specific catalyst/oil ratio, reaction temperature, reaction zone type and contact time, and by introducing the catalyst into a reaction zone in many steps to control the activity of the catalyst and the temperature in the reaction zone. In consequence, this invention has been completed.

More particularly, this invention is directed to the provision of a process for the fluid catalytic cracking of heavy fraction oils, which comprises, by using a fluid catalytic cracking reactor comprising a downflow-type reaction zone, a separation zone, a catalyst stripping zone, a catalyst-regenerating zone and a distillation zone, steps of feeding the heavy fraction oils to a raw oil introducing portion provided at a reaction zone inlet; feeding a part of a regenerated catalyst taken out of the catalyst-regenerating zone to a catalyst introducing portion provided at the reaction zone inlet to bring the heavy fraction oils into contact with catalyst; and feeding another part of the regenerated catalyst taken out of the catalyst-regenerating zone to at least one catalyst introducing portion which is provided between the catalyst introducing portion provided at the reaction zone inlet and reaction zone outlet to bring the heavy fraction oils into contact with the catalyst, the catalytic cracking in the reaction zone being carried out under conditions of a contact time of 0.1 to 3.0 sec, a reaction zone outlet temperature of 530 to 700° C. and a catalyst/oil ratio of 10 to 50 wt/wt, thereby producing light fraction olefins.

Moreover, this invention is directed to the provision of a process for the fluid catalytic cracking of heavy fraction oils, which comprises, by using a fluid catalytic cracking reactor comprising a downflow-type reaction zone, a separation zone, a catalyst stripping zone, a catalyst-regenerating zone and a distillation zone, steps of feeding the heavy fraction oils to a raw oil introducing portion provided at a reaction zone inlet; feeding a part of a regenerated catalyst taken out of the catalyst regenerating zone to a catalyst introducing portion provided at the reaction zone inlet to bring the heavy fraction oils into contact with catalyst; and feeding another part of the regenerated catalyst taken out of the catalyst regenerating zone to at least one catalyst introducing portion which is provided between the catalyst introducing portion provided at the reaction zone inlet and reaction zone outlet to bring the heavy fraction oils into contact with the catalyst; feeding as a quench oil 1 to 50% by weight of a residual oil, based on the weight of the heavy fraction oils, which comprises hydrocarbons having a boiling point of 300° C. or more to lower a temperature of a mixture of cracked products, unreacted materials and catalyst by 1 to 100° C. compared with a temperature of the mixture before quenching, the residual oil being obtained by distilling a mixture of cracked products obtained by the catalytic cracking and unreacted materials in the reaction zone, the catalytic cracking in the reaction zone being carried out under conditions of a contact time of 0.1 to 3.0 sec, a reaction zone outlet temperature of 530 to 700° C. and a catalyst/oil ratio of 10 to 50% wt/wt, thereby producing light fraction olefins.

Further, this invention is directed to the provision of a process for the fluid catalytic cracking of heavy fraction oils, which comprises the step of bringing heavy fraction oils into contact with a catalyst by using a fluid catalytic cracking reactor comprising a downflow-type reaction zone, a separation zone, a catalyst stripping zone, a catalyst-regenerating zone and a distillation zone under the following conditions:

1) a contact time in the reaction zone being in the range of 0.1 to 3.0 sec, a reaction zone outlet temperature being in the range of 530 to 700° C., and a catalyst/oil ratio being in the range of 10 to 50 wt/wt and 2) a residual oil comprising hydrocarbons which have a boiling point of 300° C. or more obtained by distilling a mixture of cracked products obtained by the catalytic cracking in the reaction zone and unreacted materials being fed to a reaction zone outlet portion in an amount of 1 to 50% by weight based on the weight of the heavy fraction oils, whereby a temperature of a mixture of cracked products, unreacted materials and catalyst is lowered by 1 to 100° C. compared with a temperature of the mixture before the residual oil is introduced, thereby producing light fraction olefins.

DESCRIPTION OF THE PREFERRED EMBODIMENTS

This invention will be described below in more detail.

Raw Oil (feedstock or charge stock)

In the fluid catalytic cracking of this invention, a heavy fraction oil is used mainly as a raw oil. The heavy fraction oil used herein includes a straight-run gas oil, a vacuum gas oil (VGO), an atmospheric-pressure distillation residue, a reduced-pressure distillation residue, a cracked gas oil, and heavy fraction oils obtained by hydrorefining said residues and gas oils. These heavy fraction oils may be used singly or jointly or as a mixture thereof with a minor portion of a light fraction oil.

Apparatus and Process

The fluid catalytic cracking reactor which can be used in this invention comprises a regenerating zone (a regenerating tower), a downflow-type reaction zone (a reactor), a separation zone (a separator), a catalyst-stripping zone and a distillation zone (fractionating tower)

The term "fluid catalytic cracking" referred to herein indicates that the above-described heavy fraction oil as the raw oil is continuously brought into contact with a catalyst kept in a fluidizing state under specific operating conditions to crack the heavy fraction oil thereby producing light fraction hydrocarbons mainly comprising light fraction olefins. The reaction zone used in an ordinary fluid catalytic cracking is a so-called riser reaction zone wherein both catalyst particles and raw oil ascend through a pipe. On the other hand, it is one of the characteristic features of this invention to employ a downflow type reaction zone wherein both catalyst particles and raw oil descend through a pipe so as to avoid the back mixing because the catalyst/oil ratio of this invention is far higher than that of an ordinary fluid catalytic cracking process.

In the usual fluid catalytic cracking, all of the catalyst which is taken out of a catalyst regenerating zone and then forwarded to a reaction zone is fed to a catalyst introducing portion provided at a reaction zone inlet. In this invention, however, a part of the regenerated catalyst taken out of the catalyst regenerating zone is fed to the catalyst introducing portion provided at the reaction zone inlet to bring the raw oil into contact with the catalyst (catalyst particles), and the other part of the regenerated catalyst taken out of the catalyst regenerating zone is fed to at least one catalyst introducing portion which is provided between the catalyst introducing portion provided at the reaction zone inlet and reaction zone outlet. The catalyst introducing portion provided between the catalyst introducing portion which is provided at the reaction zone inlet and reaction zone outlet can be provided at an optional position in the reaction zone.

In this invention, a ratio of the regenerated catalyst to be fed to the catalyst introducing portion provided at the reaction zone inlet to the regenerated catalyst taken out of the catalyst-regenerating zone can be preferably in the range of 20 to 95% by weight, more preferably 40 to 80% by weight. Herein, the raw oil is heated and gasified, and a cracking reaction is begun.

A ratio of the regenerated catalyst which is fed to the catalyst introducing portion provided between the catalyst introducing portion which is provided at the reaction zone inlet and reaction zone outlet can be preferably in the range of 5 to 80% by weight, more preferably 20 to 60% by weight to the regenerated catalyst taken out of the catalyst-regenerating zone. In the case that a plurality of catalyst introducing portions are provided between the catalyst introducing portion which is provided at the reaction zone inlet and reaction zone outlet, the amount of the regenerated catalyst can be equally or optionally divided and then fed to the respective catalyst introducing portions. According to this way, a high temperature which is advantageous for a high cracking ratio of the heavy fraction oils can be maintained all over the reaction zone. Furthermore, in the usual fluid catalytic cracking, a reaction temperature is merely heightened. and hence the production of a coke increases and the catalyst rapidly deteriorates, with the result that the cracking reaction is not sufficiently carried out in latter stage (a downstream side) of the reaction zone. According to this invention, however, the highly active catalyst can be distributed all over the reaction zone. The number of catalyst introducing portions provided between the catalyst introducing portion which is provided at the reaction zone inlet and reaction zone outlet can be 1 to 5.

In this invention, it is important to feed a part of the regenerated catalyst to the catalyst introducing portion provided between the catalyst introducing portion which is provided at the reaction zone inlet and reaction zone outlet, but since a downflow-type reaction tube is employed in the reaction zone, the catalyst can easily be allowed to drop in the reaction tube by its gravity alone or together with a small amount of a transfer gas such as water vapor. At this time, a reverse mixing of the catalyst and the raw oil by the introduced catalyst does not occur, and conversely, a remixing of the catalyst and the raw oil (an conveniently be accelerated in the middle of the reaction tube by the introduced catalyst, because the reaction tube is of the downflow type.

A mixture of products obtained by the catalytic cracking of the heavy fraction oils in contact with the catalyst kept in fluidizing state in the downflow type reaction zone, unreacted materials and catalyst is then forwarded into the separation zone.

In the case that a reaction zone outlet temperature is as very high as 530 to 700° C., the mixture of the products, the unreacted materials and the catalyst continues the cracking reaction even after it has passed the reaction zone, so that there usually occur a phenomenon called overcracking that the light fraction olefins which are preferable products further suffer the cracking to generate a dry gas, and another phenomenon called a hydrogen transfer reaction that the light fraction olefins draw hydrogen atoms from paraffins, naphthenes and aromatics, so that the light fraction olefins convert into light fraction paraffins which are unsuitable products. Particularly in the case that a higher temperature and a higher catalyst/oil ratio than in a usual fluid catalytic cracking process are employed as in this invention, these phenomena often take place.

In this invention, therefore, it is possible to forward the mixture of the products, unreacted materials and catalyst into a high-speed separation zone before the catalyst is precisely removed from the mixture of the products, unreacted materials and catalyst in a cyclone separation zone. The term "high-speed separation zone" referred to herein indicates the zone in which the residence time of gases is short and the residence time distribution is in a narrow range, while the separation efficiently is low. In the high-speed separation zone, the residence time distribution of the gases is characteristically as narrow as only 0.1 to 0.3 second, preferably 0.1 to 0.2 second, while a part of the gases stays in the cyclone separation zone for a long time and the residence time distribution of the gases in the cyclone separation zone is as wide as 0.1 to 1.0 second, in this invention, at least 90% by weight, preferably at least 95% by weight, of the catalyst is removed from the mixture of the products, unreacted materials and catalyst in the high-speed separation zone. Examples of the high-speed separation zones are a box-type and a U-bent type.

The mixture of the products, unreacted materials and catalyst is finally forwarded into the cyclone separation zone having one or more stages to remove the residual catalyst still remaining in the mixture after the removal in the high-speed separation zone.

On the other hand, the catalyst separated from the mixture in the separation zone is forwarded into a catalyst-stripping zone to remove the most part of hydrocarbons such as the products and unreacted materials from the catalyst (catalyst particles). The catalyst on which carbonaceous materials and partially heavy fraction hydrocarbons are deposited is further forwarded from said catalyst-stripping zone into a catalyst-regenerating zone. In the catalyst-regenerating zone, the catalyst on which the carbonaceous materials and partially heavy fraction hydrocarbons are deposited is subjected to oxidation treatment to mostly remove the carbonaceous materials and the hydrocarbons each deposited on the catalyst thereby obtaining a regenerated catalyst. The oxidation treatment includes combustion. The regenerated catalyst is then continuously recycled to the reaction zone.

In this invention, a concentrated fluidized bed type regenerating zone which has been used in a usual fluid catalytic cracking device can be used as the catalyst regenerating zone. A plurality of the catalyst regenerating zones can be installed, and in this case, a riser type regenerating zone which is a rising tube of a dilute fluidized bed can be used in addition to the concentrated fluidized bed type regenerating zones. Furthermore, the plurality of the concentrated fluidized bed type regenerating zones can be combined in series with the riser type regenerating zone, and in this case, it is preferred that a regenerating zone (a first regenerating zone) directly connected to a stripping zone is a riser type and the subsequent regenerating zones (second regenerating zone et seqq.) are the concentrated fluidized bed type, or alternatively, it is preferred that the regenerating zone in the last stage is the riser type and the preceding regenerating zones are the concentrated fluidized bed type.

In this invention, the completely regenerated catalyst which has passed all of the usually plural regenerating zones is divided and then fed to the catalyst introducing portion provided at the reaction zone inlet and to at least one catalyst introducing portion provided between the catalyst introducing portion which is provided at the reaction zone inlet and reaction zone outlet. To the catalyst introducing portions provided at the reaction zone inlet, an incompletely regenerated catalyst which has been drawn from the middle of a plurality of the regenerating zones can also be fed. In the case that the incompletely regenerated catalyst is fed, the catalyst having a low activity and a low temperature is introduced into the catalyst introducing portion provided at the reaction zone inlet, and as a result, the raw oil is heated, gasified and cracked under mild conditions, whereby the generation of unsuitable by-products such as the dry gas and the coke can be restrained.

The reaction zone outlet temperature referred to in this invention means a temperature at the outlet of a fluidized bed type reaction zone of a downflow system, and more concretely, it is a temperature of a mixture of the cracked products, the unreacted materials and the catalyst from which the catalyst has not been separated yet, or a temperature of the mixture which has not been cooled yet, in the case that it is cooled by a quench oil on the upstream side of a separation zone. In this invention, the reaction zone outlet temperature can be in a range of 530 to 700° C. preferably 540 to 650° C., more preferably 550 to 620° C. If the reaction zone outlet temperature is lower than 530° C. then the light fraction olefins will be unable to be obtained in a high yield, while if it is higher than 700° C., then the thermal cracking of the heavy fraction oils fed will be noticeable thereby undesirably increasing the amount of dry gases generated.

The term "catalyst/oil ratio" referred to herein indicates a ratio of the amount (ton/h) of the catalyst recycled to a rate of the raw oil fed (ton/h). In this invention, the catalyst/oil ratio can be 10–50 wt/wt, preferably 15–30 wt/wt. In this invention, since the catalytic cracking reaction is conducted in a shorter contact time than a contact time of a prior process, if a catalyst/oil ratio is less than 10, the incomplete catalytic cracking reaction undesirably occurs. On the other hand, if the catalyst/oil ratio exceeds 50, the amount of the catalyst recycled is undesirably large thereby to lower a temperature of the catalyst-regenerating zone whereby the combustion of the carbonaceous materials occurs incompletely, or whereby a catalyst residence time necessary for the regeneration of the used catalyst becomes excessively long unfavorably.

The term "contact time" referred to herein indicates either a time between the start of contact of the raw oil with the catalyst and the separation of the catalyst from the mixture of cracked products, unreacted materials and catalyst, or a time between the start of contact of the raw oil with the catalyst and the quenching in case that the mixture is quenched by quench oils just upstream of the separation zone. The contact time in this invention may be selected from the range of 0.1 to 3.0 sec., preferably 0.1 to 2.0 sec., more preferably 0.3 to 1.5 sec., most preferably 0.3 to 1.0 sec. When the contact time is less than 0.1 sec., the raw oils are unfavorably withdrawn from the reaction zone before the cracking reaction has proceeded completely. When the contact time exceeds 3.0 sec., the rate of the conversion of the light fraction olefins into light fraction paraffins is undesirably increased by the hydrogen transfer reaction and the overcracking which occur successively after the cracking reaction.

The "catalyst-concentrated phase temperature in the regenerating zone" (hereinafter referred to as "regenerating zone temperature") referred to herein indicates a temperature measured just before the catalyst particles fluidized in a concentrated state in the regenerating zone is withdrawn from said zone. In this invention, the regenerating zone temperature can be preferably 650 to 800° C., more preferably 680 to 740° C. When the regenerating zone temperature is less than 650° C., the combustion of the carbonaceous materials deposited on the catalyst is slow and said carbonaceous materials can not be completely removed thereby to make the keeping of the catalytic activity impossible, or the catalyst residence time in the regenerating zone must be prolonged to a very long time for the complete removal of the carbonaceous materials thereby unfavorably necessitating a very large regenerating zone uneconomically.

On the other hand, when the temperature is more than 800° C. the catalyst suffers a hydrothermal deterioration, and the amount of heat which the catalyst delivers from the regenerating zone to the reaction zone excessively increases, so that the temperature of the reaction zone cannot be maintained at the preferable temperature, which is economically unsuitable.

In this invention, for the purpose of inhibiting the overcracking of the light fraction olefins, the quench oil can be fed to a reaction zone outlet portion (an immediately downstream position of the outlet) to cool the mixture of the cracked products, the unreacted materials and the catalyst. By feeding the quench oil, the temperature of the mixture of the cracked products, the unreacted materials and the catalyst can be lowered by 1 to 100° C., preferably by 1 to 50° C., more preferably by 1 to 30° C., compared with the reaction zone outlet temperature. The amount of feed of the quench oil is preferably in the range of 1 to 50° C. by weight, more preferably 2 to 30% by weight, most preferably 3 to 20% by weight based on the weight of the ram oil. If the amount of feed of the quench oil is less than 1, by weight, the hydrogen transfer reaction and the overcracking reaction cannot sufficiently be stopped inconveniently. On the other hand, if the amount of feed is more than 50% by weight, the catalyst in the mixture of the cracked products, the unreacted materials and the catalyst is excessively cooled. whereby the regenerating zone temperature lowers more than the preferable temperature, which is not preferable.

In the case that a high-speed separation zone is interposed between the reaction zone and a cyclone separation zone, the quench oil can be fed between the high-speed separation zone and the cyclone separation zone.

As the quench oil, there is recycled a part of a residual oil having a boiling point of 300° C. or more which is obtained by distilling the mixture of the cracked products obtained by the catalytic cracking process of this invention and the unreacted materials and which comprises hydrocarbons containing 60% by weight or more, preferably 700, by weight or more of an aromatic content. The reasons why such a quench oil is used are as follows:

In a usual fluid catalytic cracking process, the reaction is stopped by the remarkable drop of the temperature with the quench oil (usually, a temperature gap is in the range of 180 to 350° C., and the temperature is lowered to 30° C. or less) to control the overcracking, but if this conventional process is used in this invention in which the catalyst/oil ratio is high, a large amount of the quench oil is inconveniently required to cool a large amount of the catalyst. Additionally, in this conventional process, the catalyst is noticeably cooled, and as a result, it is difficult to maintain a high regenerated catalyst temperature required to keep the high reaction zone temperature, which is the feature of this invention. On the contrary, in this invention, a small amount of the residual oil of the cracked products having high aromatic properties is used as the quench oil, whereby the hydrogen transfer reaction and the overcracking can be rapidly decreased while the temperature is scarcely lowered.

If the aromatic content in the residual oil is less than 60% by weight or the boiling point of the residual oil is less than 300° C., reactions such as the overcracking and the hydrogen transfer cannot sufficiently be stopped inconveniently.

A typical example of the quench oil is an uncracked oil. The feature of the above residual oil is that this residual oil contains hard-cracked components which have not been cracked when the raw oil has been subjected to the catalytic cracking under the reaction conditions of the high temperature and the high catalyst/oil ratio and which have remained after the catalytic cracking, and that it comprises the hydrocarbons containing the aromatic content in a very high ratio.

In the case that the residual oil is recycled, the mixture of the cracked products, the unreacted materials and the catalyst which has been taken out of the reaction zone is introduced into the separation zone, where the catalyst is then removed, and then a mixture of the cracked products and the unreacted materials is introduced into a fractionating tower, where distillation is then carried out. The residual oil obtained by the distillation is taken out of the fractionating tower, and at least a part of the taken residual oil is introduced into the reaction zone outlet portion.

In this invention, although operating conditions of the fluid catalytic cracking reaction apparatus, except those described above, are not particularly restricted, the apparatus can be operated preferably at a reaction pressure of 1 to 3 $kg/cm^2G$.

The catalyst used in this invention and a method of preparing the catalyst are not particularly limited. Catalyst particles generally used for the fluid catalytic cracking reaction of a petroleum are usable herein. Particularly, there is preferably used a catalyst comprising ultrastable Y-type zeolite as an active component and a matrix which is substrate material for the zeolite. Examples of the matrixes are clays such as kaolin, montmorillonite, halloysite and bentonite, and inorganic porous oxides such as alumina, silica, boria, chromia, magnesia, zirconia, titania and silica-alumina, and the mixture thereof. The content of the ultrastable Y-type zeolite in the catalyst used in this invention can be in a range of 2 to 60 wt %, preferably 15 to 45 wt %.

In addition to the ultrastable Y-type zeolite, there can be used a catalyst comprising a crystalline aluminosilicate zeolite or silicoaluminophosphate (SAPO) each having smaller pores than the ultrastable Y-type zeolite. The aluminosilicate zeolites and the SAPOs include ZSM-5, SAPO-5, SAPO-11 and SAPO-34. The zeolite or the SAPO may be contained in the catalyst particles containing the ultrastable Y-type zeolite, or may be contained in other catalyst particles.

The catalyst used in this invention preferably has a bulk density of 0.5 to 1.0 g/ml, an average particle diameter of 50 to 90 $\mu$m, a surface area of 50 to 350 $m^2/g$ and a pore volume of 0.05 to 0.5 ml/g.

The catalyst used in this invention can be manufactured by a usual manufacturing method. For example, a dilute water glass solution ($SiO_2$ concentration=8 to 13%) is dropped to sulfuric acid to obtain a silica sol having a pH value of 2.0 to 4.0. Thereafter, the ultrastable Y-type zeolite and kaolin are added to the whole of this silica sol and they are then kneaded to form a mixture which is then spray dried in hot air of 200 to 300° C. Afterward, the thus obtained spray dried product is washed with 0.2% ammonium sulfate at 50° C., dried in an oven at 80 to 150° C. and then fired at 400 to 700° C. to obtain a catalyst usable in this invention.

EXAMPLES

Next, this invention will be described with reference to the following examples and the like, but this invention should not be limited to these examples.

EXAMPLE 1

The catalytic cracking of desulfurized VGO produced in the Middle East was conducted with an insulating type FCC pilot apparatus (made by Xytel Company) having a downflow-type reaction zone and one catalyst-regenerating zone as the fluid catalytic cracking reaction apparatus.

21,550 g of a dilute solution ($SiO_2$ concentration=11.6%) of JIS No. 3 water glass were dropped to 3,370 g of 40% sulfuric acid to obtain a silica sol of pH value 3.0. The whole of the silica sol so obtained was incorporated with 3,000 g of an ultrastable Y-type zeolite (made by Toso Co., Ltd., HSZ-370HUA) and 4,000 g of kaolin, after which the resulting mixture was kneaded and then spray dried in hot air of 250° C. Afterward, the thus obtained spray dried product was washed with 50 liters of 0.2% ammonium sulfate at 50° C., dried in an oven at 110° C. and then fired at 600° C. to obtain a catalyst. In this case, the content of the zeolite in the catalyst was 30 wt %. A bulk density of thus obtained catalyst was 0.7 g/ml, an average particle diameter of it was 71 $\mu$m, a surface area of it was 180 $m^2$/g and a pore volume of it was 0.12 ml/g. Prior to feeding the catalyst into the apparatus, the catalyst was subjected to steaming at 800° C. for 6 hours with 100% steam in order to bring the catalyst into a pseudo-equilibrium state.

The scale of the apparatus was as follows:

The inventory (amount of the catalyst) was 2 kg, the raw oil feed was 1 kg/h. The desulfurized VGO was fed at 1 kg/h to a raw oil introducing portion provided at a reaction zone inlet of this apparatus, and a regenerated catalyst was fed at 10 kg/h to a catalyst introducing portion disposed at the reaction zone inlet. On the other hand, a regenerated catalyst was fed at 2 kg/h together with a small amount of a nitrogen gas to one nozzle of catalyst introducing portion provided ½ of the total length of the reaction zone apart downstream (the lower part) from the reaction zone inlet (a catalyst/oil ratio =12 wt/wt).

At this time, a regenerating zone temperature was 740° C., a reaction zone inlet temperature was 610° C., a reaction zone outlet temperature was 600° C., and a contact time over the total length of the reaction zone was 0.5 second. A yield of the cracked products at this time is shown in Table 1.

EXAMPLE 2

Catalytic cracking was carried out using the same apparatus, catalyst and raw oil as in Example 1 and under the same conditions as in Example 1, and a mixture of cracked products and the unreacted materials was then distilled to obtain a residual oil having a boiling point of 343° C. or more. A part (5% by weight, based on the weight of the raw oil) of the thus obtained residual oil was recycled to introduce it at 50 g/h into an immediately downstream position of a reaction zone outlet. Therefore, after the residual oil was introduced, a temperature of a mixture of the cracked products, the unreacted materials and the catalyst was 596° C. which was 4° C. lower than the reaction zone outlet temperature. A yield of the cracked products at this time is shown in Table 1.

EXAMPLE 3

Catalytic cracking was carried out using the same apparatus, catalyst and raw oil as in Example 1 and under the same conditions as in Example 1 except that a contact time was 1.5 second. A yield of the cracked products at this time is shown in Table 1.

EXAMPLE 4

The same apparatus, catalyst and raw oil as in Example 1 were used, and with regard to the conditions of operation, a catalyst/oil ratio was 20, a reaction zone outlet temperature was 600° C., and a contact time was 0.5 sec. A mixture of cracked products obtained by catalytic cracking in a reaction zone and the unreacted materials was distilled to obtain a residual oil having a boiling point of 343° C. or more (an aromatic content =83%, by weight). A part (5% by weight, based on the weight of the raw oil) of thus obtained residual oil was recycled to introduce it at 50 g/h into an immediately downstream position of a reaction zone outlet. A remaining residual oil was taken out as a product oil. Therefore, after the residual oil was introduced, a temperature of a mixture of the cracked products, the unreacted materials and the catalyst was 596° C. which was 4° C. lower than the reaction zone outlet temperature. A yield of the cracked products at this time is shown in Table 2.

Comparative Example 1

The same apparatus, catalyst and raw oil as in Example 1 were used, and a regenerated catalyst was introduced at 12 kg/h into a catalyst introducing portion alone provided at a reaction zone inlet to carry out a cracking reactions A this time, a reaction zone inlet temperature was 625° C. and the other reaction conditions were the same as in Example 1. A yield of the cracked products at this time is shown in Table 1.

Comparative Example 2

The same cracking of desulfurized VGO as in Example 1 was conducted using an FCC pilot apparatus which contains a heat insulation type upflow reaction zone (a riser) and one catalyst-regenerating zone and using the same catalyst as in Example 1. An apparatus scale was the same as in Example 1.

A regenerated catalyst was introduced at 10 kg/h into a catalyst introducing portion provided at a reaction zone inlet of this apparatus, and on the other hand, a regenerated (catalyst was fed at 2 kg/h together with a small amount of a nitrogen gas to one nozzle of catalyst introducing portion provided ½ of the total length or the reaction zone apart downstream (the upper part) from the reaction zone inlet. Incidentally, the other reaction conditions were the same as in Example 1. A yield of the cracked products at this time is shown in Table 1

Comparative Example 3

All the same experiment as in Example 4 was conducted except that a residual oil was not recycled. A yield of the cracked products at this time is shown in Table 2.

Comparative Example 4

Cracking was carried out using the same apparatus, catalyst and raw oil as in Example 4 under the same reaction conditions as in Example 4 except that, instead of the recycling of a residual oil, a dry gas was recycled at 100 g/h (10% by weight, based on the weight of the raw oil) to introduce it into an immediately downstream position of a reaction zone outlet. Therefore, after the residual oil was introduced, a temperature of a mixture of the cracked products, the unreacted materials and the catalyst was 592° C. which was 8° C. lower than the reaction zone outlet temperature. A yield of the cracked products at this time is shown in Table 2.

Comparative Example 5

Cracking was carried out under the same reaction conditions inclusive of the recycling of a residual oil as in Example 4 except that a reaction tower was of an upflow type. After the residual oil was introduced, a temperature of a mixture of cracked products, an unreacted material and a catalyst was 596° C., which was 4° C. lower than the reaction zone outlet temperature. A yield of the cracked products at this time is shown in Table 2.

TABLE 1

| | | Ex. 1 | Ex. 2 | Ex. 3 | Comp. Ex. 1 | Comp. Ex. 2 |
|---|---|---|---|---|---|---|
| Reaction zone type | | downflow | downflow | downflow | downflow | upflow |
| Conversion rate | (wt %) | 81.0 | 81.0 | 85.3 | 81.3 | 80.7 |
| Yields | (wt %) | | | | | |
| dry gases | ($H_2$, $C_1$, $C_2$) | 6.4 | 6.1 | 7.5 | 7.1 | 7.2 |
| ethylene | | 1.9 | 2.0 | 2.5 | 2.0 | 2.2 |
| propylene | | 9.7 | 9.8 | 10.0 | 9.4 | 9.0 |
| butene | | 13.4 | 13.7 | 13.5 | 12.7 | 12.3 |
| propane, butane | | 3.2 | 3.1 | 4.4 | 3.5 | 3.6 |
| gasoline | | 42.8 | 42.8 | 43.3 | 42.9 | 42.4 |
| Light Cycle Oil (LCO) | | 11.3 | 11.3 | 9.5 | 11.1 | 11.6 |
| Heavy Cycle Oil (HCO) | | 7.7 | 7.7 | 5.2 | 7.6 | 7.7 |
| coke | | 3.6 | 3.5 | 4.1 | 3.8 | 4.0 |

TABLE 2

| | | Ex. 4 | Comp. Ex. 3 | Comp. Ex. 4 | Comp. Ex. 5 |
|---|---|---|---|---|---|
| Reaction zone type | | downflow | downflow | downflow | upflow |
| Conversion rate | (wt %) | 82.4 | 82.4 | 82.4 | 81.1 |
| Yields | (wt %) | | | | |
| dry gases | ($H_2$, $C_1$, $C_2$) | 6.5 | 7.9 | 7.6 | 6.5 |
| ethylene | | 1.8 | 1.9 | 2.0 | 2.0 |
| propylene | | 10.2 | 9.4 | 9.5 | 9.9 |
| butene | | 13.9 | 12.7 | 12.8 | 12.5 |
| propane, butane | | 3.1 | 3.5 | 3.5 | 3.3 |
| gasoline | | 43.1 | 42.9 | 42.9 | 42.8 |
| Light Cycle Oil (LCO) | | 10.2 | 10.2 | 10.2 | 10.7 |
| Heavy Cycle Oil (HCO) | | 7.4 | 7.4 | 7.4 | 8.2 |
| coke | | 3.8 | 4.2 | 4.1 | 4.1 |

In the tables, $C_1$ represents methane gas and $C_2$ represents ethane gas, and the conversion rate indicates that of the raw oil into the cracked products.

From the results, it is apparent that when an equal amount of a catalyst is used, a process in which the catalyst is introduced into a downflow type reaction zone separately in two steps as in Examples 1 to 3 permits obtaining light fraction olefins in the highest yield. Furthermore, when a residual oil is recycled as in Example 2, the light fraction olefins can be obtained in a higher yield.

On the other hand, in the case of Comparative Example 1 in which the catalyst is introduced in one step as in a conventional fluid catalytic cracking process, a reaction zone inlet temperature is high, so that the cracking is vigorous, with the result that yields of a dry gas and a coke increase inconveniently.

Furthermore, in the case of Comparative Example 2 in which an upflow type reaction zone is used, flows of the catalyst and the gas are disturbed at a downstream catalyst introducing position, so that reverse mixing is vigorous, with the result that yields of a dry gas and a coke increase inconveniently.

This fact can be supposed to be for the following reasons. A part of the catalyst resides in the reaction zone for a long time owing to the reverse mixing, so that the deterioration of the catalyst proceeds, and a residence time distribution of the gas is spread. In consequence, for a part of the gas, the residence time is short and the cracking does not proceed, and for another part of the gas, the residence time is long and the overcracking proceed.

Moreover, by recycling the residual oil and introducing it into a reaction zone outlet, a hydrogen transfer reaction and the overcracking of the oils can be inhibited in contrast with a case where the residual oil is not recycled (Comparative Example 3), a case where the dry gas is recycled in place of the residual oil (Comparative Example 4), and a case where an upflow reaction tower is used (Comparative Example 5). In consequence, the light fraction olefins can be obtained in a high yield.

The hydrogen transfer reaction and the overcracking of the oils can also be inhibited by lowering the temperature of the above mixture even with a quench gas such as the dry gas, but in this invention, a catalyst/oil ratio is high as compared with a usual catalytic cracking process for the purpose of heightening a cracking ratio and the yield of the light fraction olefins. Therefore, the temperature scarcely lowers, considering a fact that the amount of the quench gas is larger than that of the residual oil, and hence, an effect of stopping the reaction is found to be low as compared with the case of using the residual oil.

As described above, according to the fluid catalytic cracking process of a heavy fraction oil regarding this invention, the generation of the dry gas can be inhibited, and the light fraction olefins can be obtained in a high yield.

What is claimed is:

1. A process for the fluid catalytic cracking of heavy fraction oils, which comprises the steps of:

a) feeding the heavy fraction oils to a raw oil introducing inlet provided at a downflow reaction zone inlet to bring the heavy fraction oils into contact with a regenerated catalyst, with the catalytic cracking being carried out under conditions of a contact time of 0.1 to 3.0 sec, a reaction zone outlet temperature of 530 to 700° C. and a catalyst/oil ratio of 10 to 50 wt/wt to obtain a mixture of cracked product, unreacted material and spent catalyst;

b) feeding the mixture of cracked product, unreacted material and scent catalyst into a separation zone and separating spent catalyst from the mixture;

c) feeding spent catalyst separated from the mixture in the separation zone into a catalyst-stripping zone to remove hydrocarbons from the catalyst;

d) feeding spent catalyst taken out of the catalyst-stripping zone into a catalyst-regenerating zone to remove the carbonaceous material and hydrocarbons deposited on the spent catalyst thereby obtaining the regenerated catalyst;

e) feeding a part of the regenerated catalyst taken out of the catalyst-regenerating zone into a catalyst introducing inlet provided at the reaction zone inlet; and f) feeding another part of the regenerated catalyst taken out of the catalyst-regenerating zone into one to five intermediate catalyst introducing inlets which are provided between the catalyst introducing inlet provided at the reaction zone inlet and a reaction zone outlet.

2. A process according to claim 1, wherein said process further comprises the steps of:

g) feeding a mixture of cracked product and unreacted material from the separation zone and from the catalyst-stripping zone into a distillation zone where distillation is carried out; and h) feeding as a quench oil 1 to 50% by weight of a residual oil based on the weight of the heavy fraction oil into a reaction zone outlet to lower a temperature of the mixture of cracked product, unreacted material and spent catalyst by 1 to 100° C. compared with a temperature of the mixture before quenching, with said residual oil comprising hydrocarbons having a boiling point of 300° C. or more and with said residual oil being obtained by distillation of the mixture of the cracked product and unreacted material and taken out of the distillation zone.

3. A process according to claim 1, wherein a ratio of the part of regenerated catalyst to be fed to the catalyst introducing inlet provided at the reaction zone inlet to the regenerated catalyst taken out of the catalyst regenerating zone is in the range of 20 to 95% by weight, and a ratio of another part of regenerated catalyst which is fed to the one to five intermediate catalyst introducing inlets provided between the catalyst introducing inlet which is provided at the reaction zone inlet and the reaction zone outlet is in the range of 5 to 80% by weight to the regenerated catalyst taken out of the catalyst regenerating zone.

4. A process according to claim 2, wherein a ratio of the part of regenerated catalyst to be fed to the catalyst introducing inlet provided at the reaction zone inlet to the regenerated catalyst taken out of the catalyst regenerating zone is in the range of 20 to 95% by weight, and a ratio of another part of regenerated catalyst which is fed to the one to five intermediate catalyst introducing inlets provided between the catalyst introducing inlet which is provided at the reaction zone inlet and the reaction zone outlet is in the range of 5 to 80% by weight to the regenerated catalyst taken out of the catalyst regenerating zone.

5. A process according to claim 1, wherein the catalyst-regenerating zone comprises a plurality of catalyst-regenerating zones, and the process further comprises the steps of feeding a semi-regenerated catalyst drawn from the middle of the catalyst-regenerating zones to the catalyst introducing inlet provided at the reaction zone inlet; and feeding the regenerated catalyst which has passed all the catalyst-regenerating zones to the one to five intermediate catalyst introducing inlets provided between the catalyst introducing inlet which is provided at the reaction zone inlet and the reaction zone outlet.

6. A process according to claim 2, wherein the catalyst-regenerating zone comprises a plurality of catalyst-regenerating zones, and the process further comprises the steps of feeding a semi-regenerated catalyst drawn from the middle of the catalyst-regenerating zones to the catalyst introducing inlet provided at the reaction zone inlet; and feeding the regenerated catalyst which has passed all the catalyst-regenerating zones to the one to five intermediate catalyst introducing inlets provided between the catalyst introducing inlet which is provided at the reaction zone inlet and the reaction zone outlet.

7. A process according to claim 5, wherein parts of the plural catalyst regenerating zones are riser type regenerating zones, and the other catalyst regenerating zones are concentrated fluidized bed type regenerating zones.

8. A process according to claim 6, wherein parts of the plural catalyst regenerating zones are riser type regenerating zones, and the other catalyst regenerating zones are concentrated fluidized bed type regenerating zones.

9. A process for the catalytic cracking of heavy fraction oils, which comprises the steps of:

a) feeding the heavy fraction oils to a raw oil introducing inlet provided at a downflow reaction zone inlet to bring the heavy fraction oils into contact with a regenerated catalyst, with the catalytic cracking being carried out under conditions of a contact time of 0.1 to 3.0 sec, a reaction zone outlet temperature of 530 to 700° C. and a catalyst/oil ratio of 10 to 50 wt/wt to obtain a mixture of cracked product, unreacted material and spent catalyst;

b) feeding the mixture of cracked product, unreacted material and spent catalyst into a separation zone:

c) feeding spent catalyst separated from the mixture in the separation zone into a catalyst-stripping zone to remove hydrocarbons from the catalyst;

d) feeding a mixture of the cracked product and unreacted material from the separation zone and from the catalyst-stripping zone into a distillation zone where distillation is carried out;

e) feeding as a quench oil 1 to 50% by weight of a residual oil based on the weight of the heavy fraction oil into a reaction zone outlet portion to lower a temperature of the mixture of cracked product, unreacted material and spent catalyst by 1 to 100° C. compared with a temperature of the mixture before quenching, with said residual oil comprising hydrocarbons having a boiling point of 300° C. or more and containing 60% by weight or more of an aromatic content, and with said residual oil being obtained by distillation of the mixture of the cracked product and unreacted material and taken out of the distillation zone;

f) feeding spent catalyst taken out of the catalyst-stripping zone into a catalyst-regenerating zone to remove carbonaceous material and hydrocarbons deposited on the spent catalyst thereby obtaining the regenerated catalyst; and g) feeding the regenerated catalyst taken out of the catalyst-regenerating zone into the reaction zone.

* * * * *

UNITED STATES PATENT AND TRADEMARK OFFICE

CERTIFICATE OF CORRECTION

PATENT NO. : 6,045,690

DATED : April 4, 2000

INVENTOR(S) : Yuichiro FUJIYAMA et al.

It is certified that error appears in the above-indentified patent and that said Letters Patent is hereby corrected as shown below:

On the cover page, left column, Item [73] Assignee, "Nippon Oil Co., Ltd., Tokyo, Japan" should be -- Nippon Oil Co., Ltd. and Petroleum Energy Center, both Tokyo, Japan-- .

Signed and Sealed this

Twenty-seventh Day of February, 2001

Attest:

Nicholas P. Godici

NICHOLAS P. GODICI

Attesting Officer

Acting Director of the United States Patent and Trademark Office